US008284979B2

(12) United States Patent
Song

(10) Patent No.: US 8,284,979 B2
(45) Date of Patent: Oct. 9, 2012

(54) METHOD OF MAKING SOUND HOLE IN CASE OF CONDENSER MICROPHONE AND THE CONDENSER MICROPHONE CASE

(75) Inventor: Chung-Dam Song, Seoul (KR)

(73) Assignee: BSE Co., Ltd., Incheon (KR)

( * ) Notice: Subject to any disclaimer, the term of this patent is extended or adjusted under 35 U.S.C. 154(b) by 381 days.

(21) Appl. No.: 12/637,284

(22) Filed: Dec. 14, 2009

(65) Prior Publication Data

US 2011/0002495 A1 Jan. 6, 2011

(30) Foreign Application Priority Data

Feb. 11, 2009 (KR) ..... 10-2009-0011170

(51) Int. Cl.
*H04R 25/00* (2006.01)

(52) U.S. Cl. ..... 381/369; 381/355; 29/594

(58) Field of Classification Search ..... 29/594; 381/355–358, 365, 369, 170–171, 174–175
See application file for complete search history.

(56) References Cited

U.S. PATENT DOCUMENTS 6,885,751 B2 * 4/2005 Pribyl ..... 381/355
7,206,428 B2 * 4/2007 Geschiere et al. ..... 381/355
7,352,873 B2 * 4/2008 Shigeno et al. ..... 381/355

* cited by examiner

*Primary Examiner* — Suhan Ni
(74) *Attorney, Agent, or Firm* — Ladas & Parry LLP

(57) ABSTRACT

Provided are a method of forming a sound hole in a condenser microphone case that prevents foreign substances from being thrown to improve reliability and the condenser microphone case. The method of forming the sound hole in the condenser microphone case includes cutting a portion of a bottom surface of a metal case in the cylindrical metal case having an opened side to mount components for a microphone, and simultaneously, pressing the cut portion to form a sound hole having a gap shape at the cut portion.

5 Claims, 10 Drawing Sheets

METHOD OF MAKING SOUND HOLE IN CASE OF CONDENSER MICROPHONE AND THE CONDENSER MICROPHONE CASE

BACKGROUND OF THE INVENTION

1. Field of the Invention

The present invention relates to a case of a condenser microphone, and more particularly, to a method of forming a sound hole in a case of a condenser microphone that prevents foreign substances from entering the case to improve reliability and the condenser microphone case.

2. Description of the Related Art

Generally, condenser microphones widely used for mobile communication terminals and audio devices are classified into a condenser microphone for an electromagnetic interference (EMI), a ceramic condenser microphone, a micro-electric mechanical system (MEMS) condenser microphone, and a digital condenser microphone according to structures and characteristics of the condenser microphones. Such a condenser microphone includes a metal case, which fixes internal components to one assembly to improve acoustic characteristics.

As shown in FIG. 1, a general condenser microphone case 10 has one or a plurality of sound holes 10*a* for introducing external sound waves. Although the plurality of sound holes 10*a* is defined in a cylindrical case 10 in FIG. 1, one or a plurality of sound holes may be defined in a rectangular parallelepiped case.

As the demands of the customers increases now, products that are normally operable at worst environment conditions are required. For this, reliability of the products is further required. In case of a condenser microphone, the fact that foreign substances are introduced into the inside thereof through sound holes defined in a case is the main reason for reliability reduction. To solve this limitation, nonwoven fabrics may be added to the inside or outside of the sound holes. In case where the nonwoven fabrics are used, there are limitations that a manufacturing process for attaching the nonwoven fabrics is added, as well as, foreign substances adhere to the nonwoven fabrics to reduce the reliability.

Thus, each of the sound holes defined in the case may increase in size to prevent the foreign substances from being introduced. However, in a typical sound hole forming process, since the sound hole may be limited in size due to processing limitations, it is difficult to prevent the foreign substances from being introduced.

SUMMARY OF THE INVENTION

Accordingly, the present invention is directed to a method of manufacturing a sound hole in a case of a condenser microphone and the condenser microphone case that substantially obviate one or more problems due to limitations and disadvantages of the related art.

An object of the present invention is to provide a method of manufacturing a sound hole in a case of a condenser microphone, in which the sound hole decreases in size to prevent foreign substances from being introduced and the condenser microphone case.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a method of forming a sound hole in a condenser microphone case including: cutting a portion of a bottom surface of a metal case in the cylindrical metal case having an opened side to mount components for a microphone, and simultaneously, pressing the cut portion to form a sound hole having a gap shape at the cut portion.

To achieve these objects and other advantages and in accordance with the purpose of the invention, as embodied and broadly described herein, there is provided a condenser microphone case including: a rectangular parallelepiped metal case having an opened side, wherein a portion of a bottom surface of the metal case is cut, and simultaneously, the cut portion is pressed to form a sound hole having a gap shape at the cut portion.

To achieve these objects and other advantages and in accordance with the purpose of the invention, as embodied and broadly described herein, there is provided a condenser microphone case including: a cylindrical metal case having an opened side, wherein a portion of a bottom surface of the metal case is cut, and simultaneously, the cut portion is pressed to form a sound hole having a gap shape at the cut portion.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Objects of the present invention will become evident through the following preferred embodiments. The following embodiments are used only for explaining a specific exemplary embodiment while not limiting the present invention.

Figure 1:
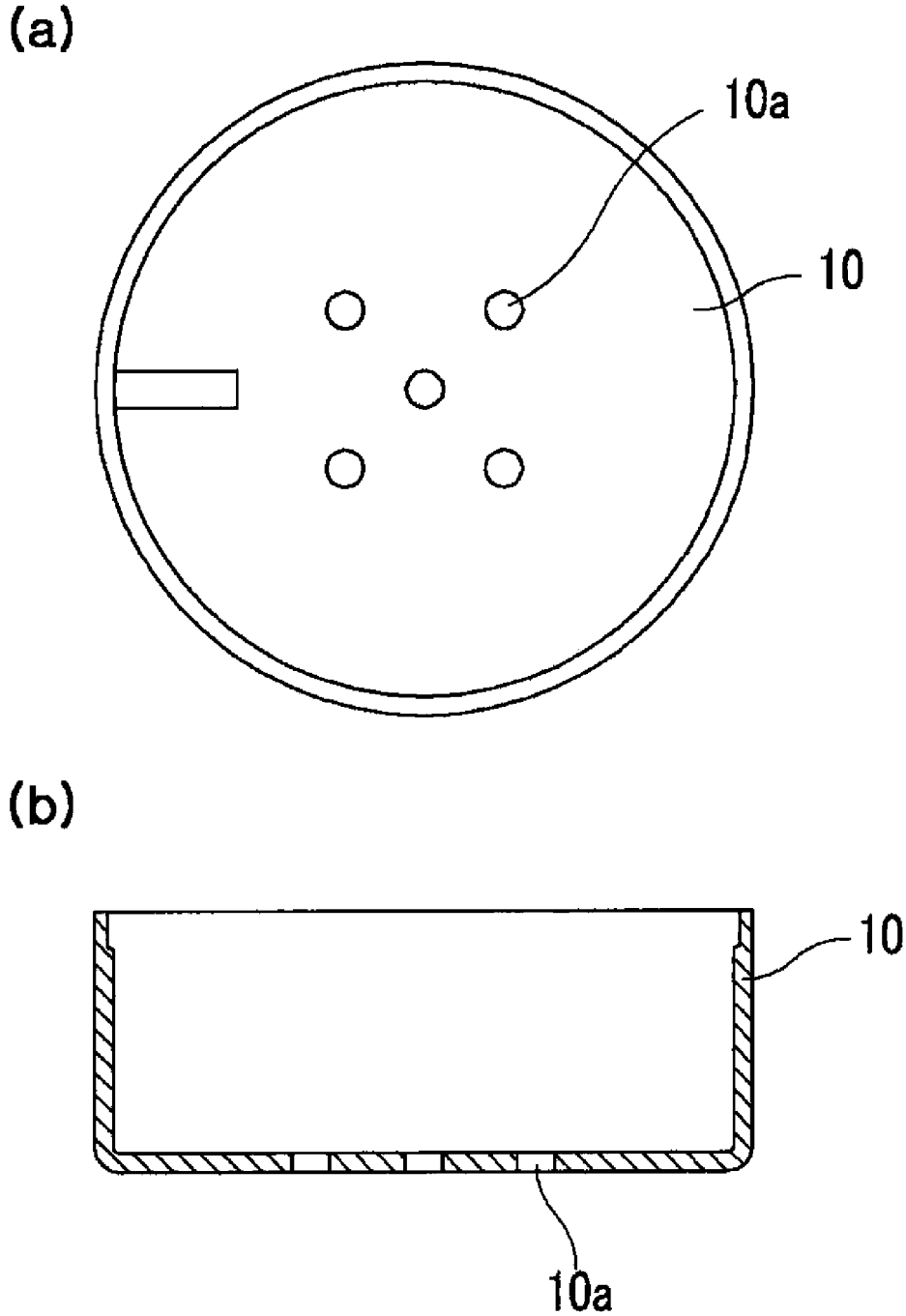
FIG. 1 is a view of a typical condenser microphone case, (a) is a plan view, and (b) is a side view.
Figure 2:
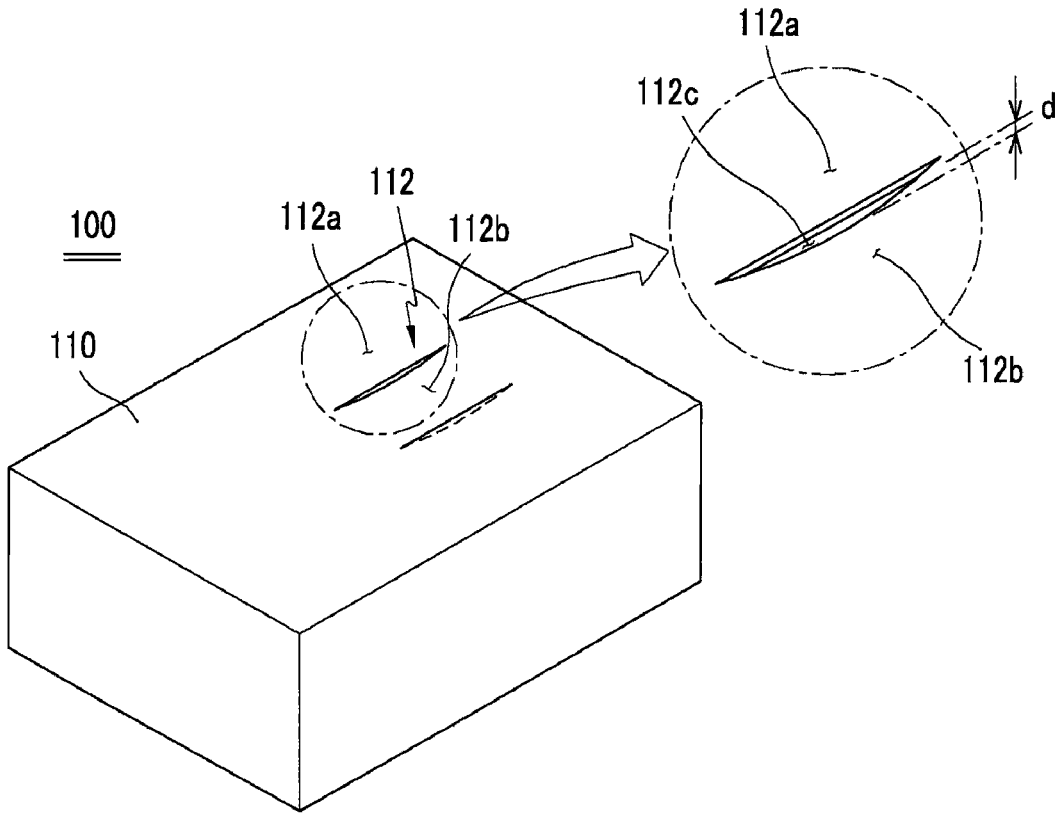
FIG. 2 is a perspective view illustrating an example of a case of a rectangular parallelepiped condenser microphone in which a straight-type gap is formed according to the present invention.
Figure 3:
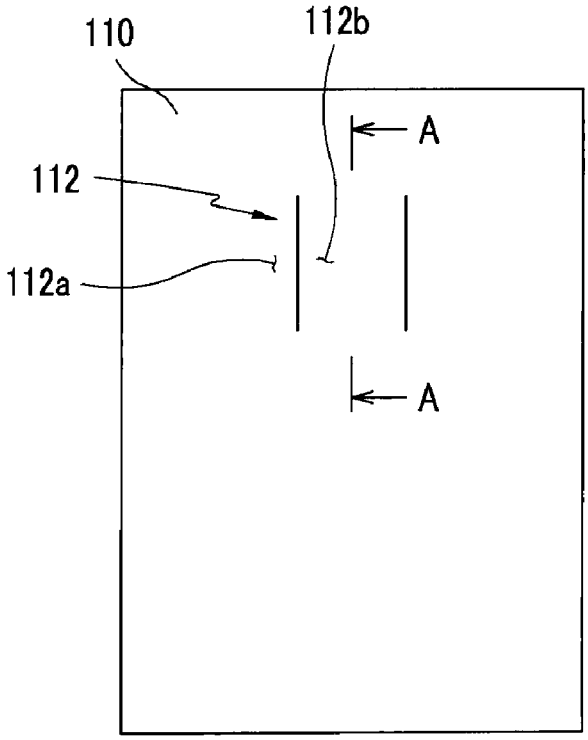
FIG. 3 is a plan view of the case illustrated in FIG. 2.
Figure 4:
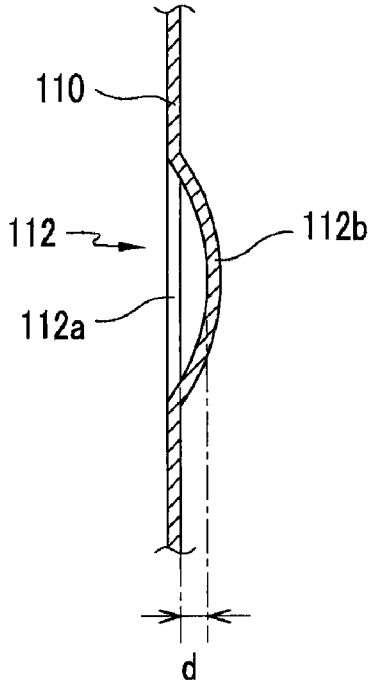
FIG. 4 is a side-sectional view of the case illustrated in FIG. 2.
Figure 5:
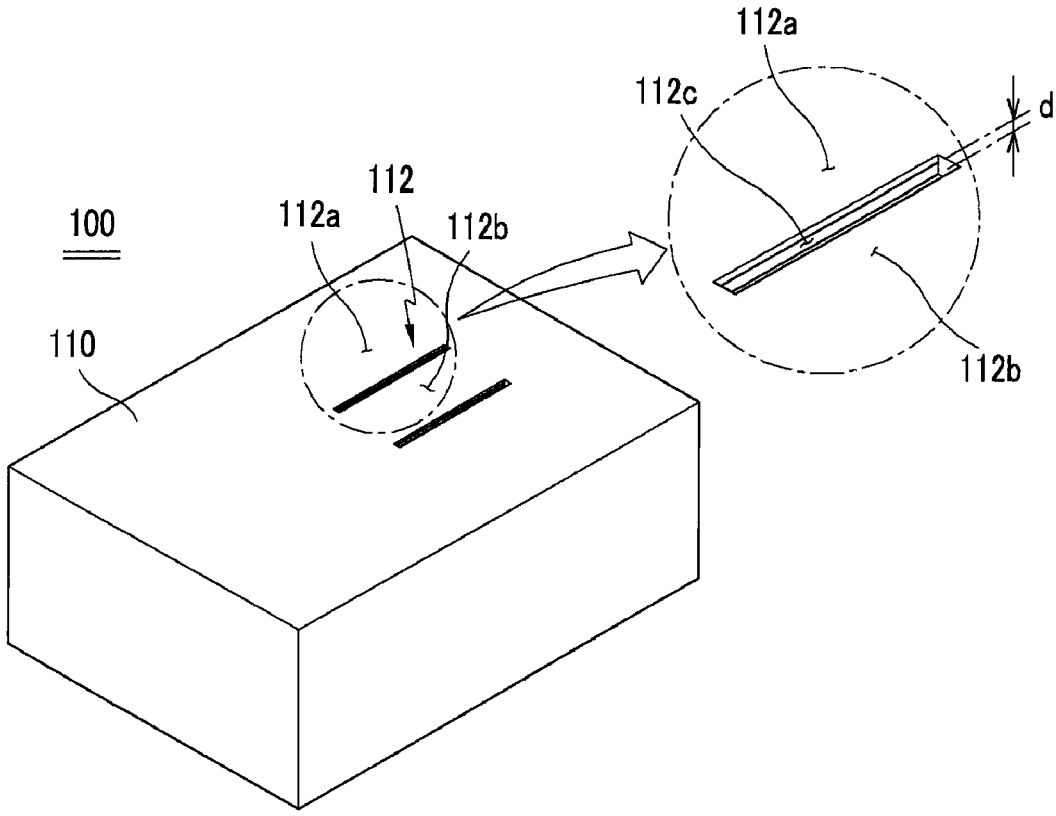
FIG. 5 is a perspective view illustrating another example of a case of a rectangular parallelepiped condenser microphone in which a straight-type gap is defined according to the present invention.
Figure 6:
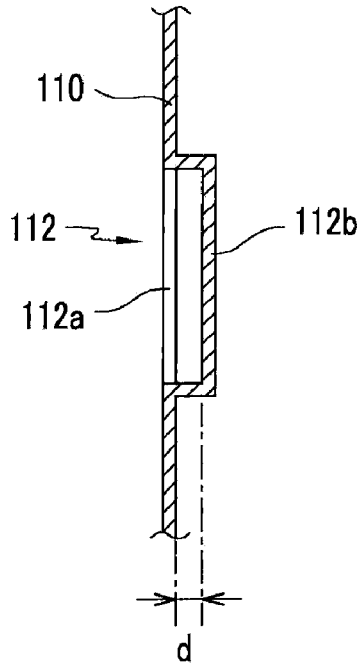
FIG. 6 is a side-sectional view of the case illustrated in FIG. 5.

FIG. 2 is a perspective view illustrating an example of a case of a rectangular parallelepiped condenser microphone in which a straight-type gap is formed according to the present invention, and FIG. 3 is a plan view of the case illustrated in FIG. 2. FIG. 4 is a side-sectional view of the case illustrated in FIG. 2, and FIG. 5 is a perspective view illustrating another example of a case of a rectangular parallelepiped condenser microphone in which a straight-type gap is defined according to the present invention. FIG. 6 is a side-sectional view of the case illustrated in FIG. 5. The embodiments of FIGS. 2 to 5 have the same function and structure as those of FIGS. 5 and 6 except a gap configuration according to a press device (method).

Referring to FIGS. 2 to 5, in a condenser microphone case 100 according to the present invention, a portion of a bottom surface 110 of a metal case having a rectangular parallelepiped shape and an opened side is straightly cut, and then, the cut portion 112*b* is pressed. Also, a sound hole 112 is defined in a gap shape 112*c* between a portion 112*a* that is not pressed and a pressed portion 112*b*. A size d of the gap 112*c* may be finely controlled. That is, the gap 112*c* has a size through which sound waves passes, but foreign substances such as dusts, solder fluxes, and water do not pass.

Also, a water repellent may be coated on a top surface or a bottom surface of a portion in which the sound hole 112 having the gap shape 112*c* is defined to further prevent the water from flowing therein due to a repulsive force when the condenser microphone case 100 contacts the water.

In case of the sound hole 112 having the straight-type gap 112*c* according to the present invention, only a cut surface is shown when viewed in plan as illustrated in FIG. 3. Also, when viewed form a side as illustrated in FIGS. 4 and 6, it is seen that the gap 112*c* formed by inwardly bending a side of the cut surface 112*b* serves as a sound hole for passing a sound wave. Thus, the sound hole 112 defined according to the present invention may pass through the sound wave and prevents foreign substances from being introduced into the inside to improve reliability of the condenser microphone to which the case 100 of the present invention is applied.

Figure 7:
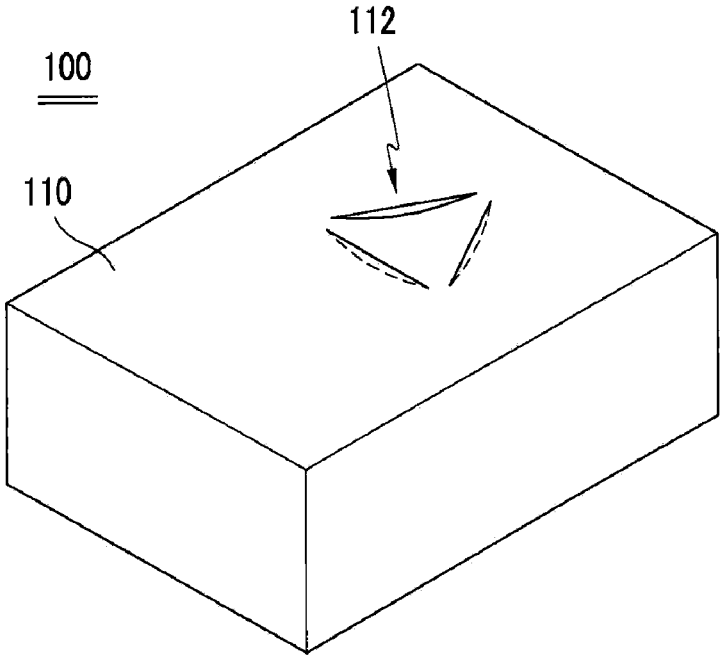
FIG. 7 is a view of a rectangular parallelepiped condenser microphone case in which a sound hole having a triangular shape is defined according to the present invention.
Figure 8:
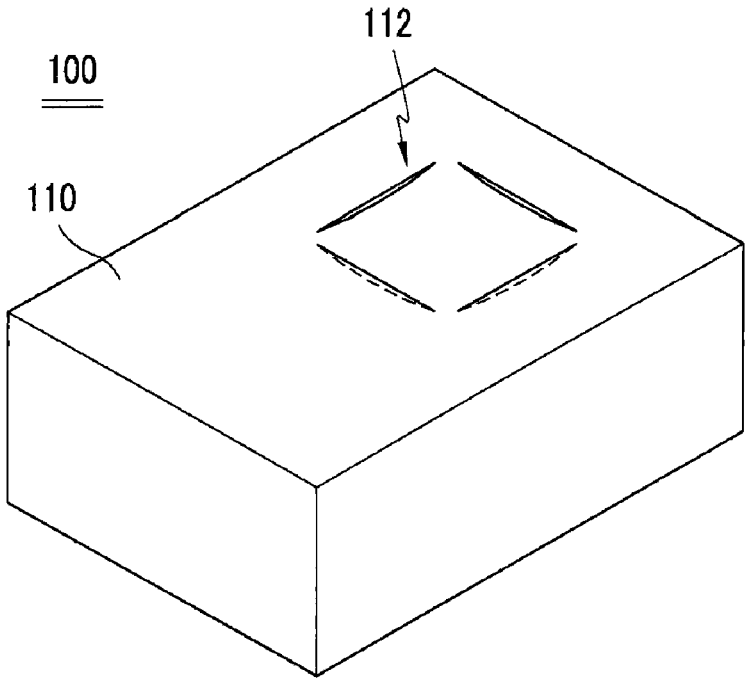
FIG. 8 is a view of a rectangular parallelepiped condenser microphone case in which a sound hole having a rectangular shape is defined according to the present invention.
Figure 9:
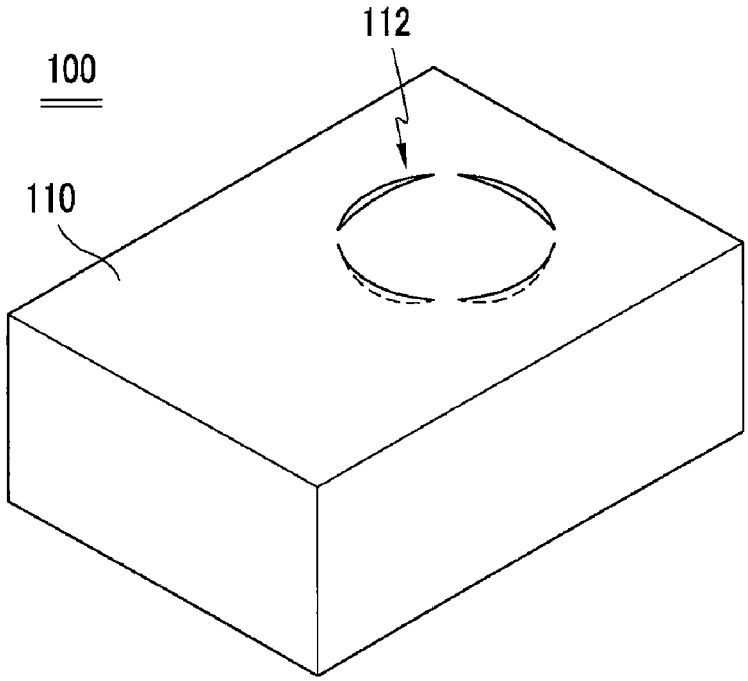
FIG. 9 is a view of a rectangular parallelepiped condenser microphone case in which a sound hole having a circular shape is defined according to the present invention.

FIG. 7 is a view of a rectangular parallelepiped condenser microphone case 100 in which a sound hole 112 having a triangular shape is defined according to the present invention, FIG. 8 is a view of a rectangular parallelepiped condenser microphone case in which the sound hole 112 having a rectangular shape is defined according to the present invention, and FIG. 9 is a view of a rectangular parallelepiped condenser microphone case in which the sound hole 112 having a circular shape is defined according to the present invention.

As shown in FIG. 2, one or more sound holes 112 defined in the bottom surface 110 of the metal case having the rectangular shape according to the present invention may be disposed in a straight shape. Alternatively, as shown in FIGS. 7 and 9, the sound hole 112 may have various geometric shapes according to a configuration of a press device.

Referring to FIG. 7, in the rectangular parallelepiped condenser microphone case 100 having an opened side to mount components according to the present invention, a portion of the bottom surface 110 of the meal case is cut into the triangular shape in which vertexes thereof are connected to each other, and simultaneously, a side of the cut portion is pressed to form three sound holes 112 at the cut portion.

Referring to FIG. 8, in the rectangular parallelepiped condenser microphone case 100 having an opened side to mount components according to the present invention, a portion of the bottom surface 110 of the meal case is cut into the triangular shape in which vertexes thereof are connected to each other, and simultaneously, a side of the cut portion is pressed to form four sound holes 112 at the cut portion.

Referring to FIG. 9, in the rectangular parallelepiped condenser microphone case 100 having an opened side to mount components according to the present invention, a portion of the bottom surface 110 of the meal case is cut into the circular shape, and simultaneously, a side of the cut portion is pressed to form a plurality of sound holes 112 at the cut portion.

According to a method of forming a sound hole 212 in a cylindrical metal case 200 according to the present invention, as shown in FIGS. 10 to 13, in the cylindrical metal case 200 having an opened side to mount components for the microphone, a portion of the bottom surface 110 of the meal case is cut, and simultaneously, a side of the cut portion is pressed to form a gap serving as a sound hole at the cut portion. At this time, a water repellent may be coated on a top surface or a bottom surface of a portion in which the sound hole 212 having a gap shape is defined to further prevent the water from flowing therein due to a repulsive force when the condenser microphone case 200 contacts the water.

Figure 10:
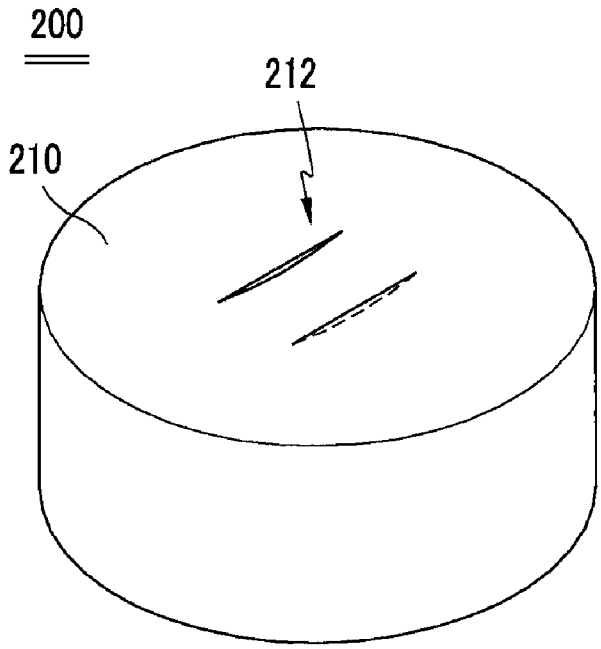
FIG. 10 is a view of a cylindrical condenser microphone case in which a straight-type sound hole is defined in a bottom surface thereof according to the present invention.
Figure 11:
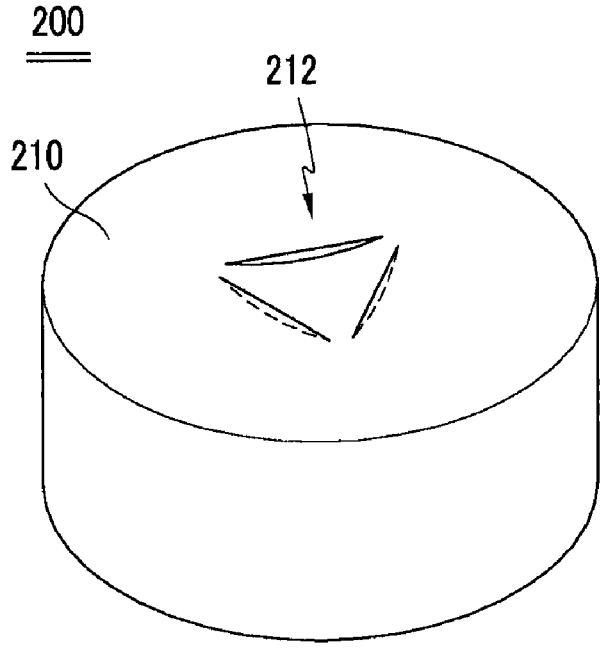
FIG. 11 is a view of a cylindrical condenser microphone case in which a triangular-type gap is defined in a bottom surface thereof according to the present invention.
Figure 12:
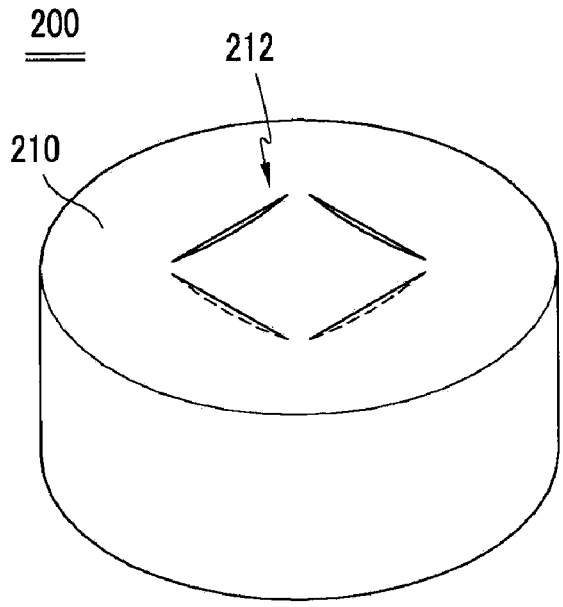
FIG. 12 is a view of a cylindrical condenser microphone case in which a rectangular-type gap is defined in a bottom surface thereof according to the present invention.
Figure 13:
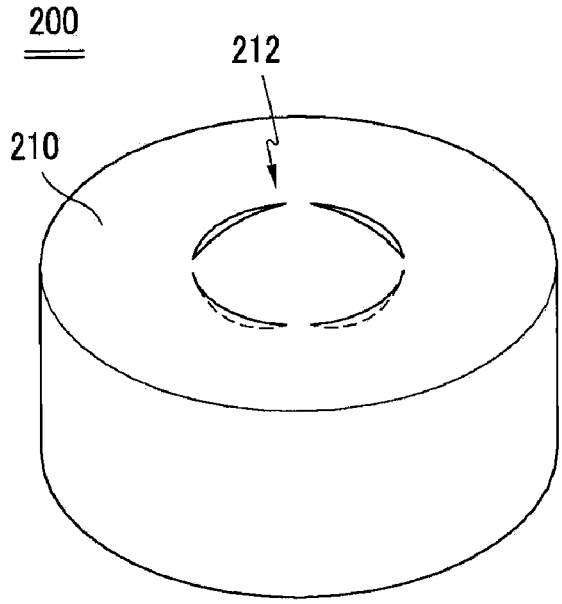
FIG. 13 is a view of a cylindrical condenser microphone case in which a circular-type gap is defined in a bottom surface thereof according to the present invention.

FIG. 10 is a view of a cylindrical condenser microphone case in which a straight-type sound hole is defined in a bottom surface thereof according to the present invention, and FIG. 11 is a view of a cylindrical condenser microphone case in which a triangular-type gap is defined in a bottom surface thereof according to the present invention. FIG. 12 is a view of a cylindrical condenser microphone case in which a rectangular-type gap is defined in a bottom surface thereof according to the present invention, and FIG. 13 is a view of a cylindrical condenser microphone case in which a circular-type gap is defined in a bottom surface thereof according to the present invention.

Referring to FIG. 10, in the cylindrical metal case 200 having an opened side to mount components according to the present invention, a portion of a bottom surface 210 of the meal case 200 is cut into the triangular shape in which vertexes thereof are connected to each other, and simultaneously, a side of the cut portion is pressed to form three sound holes 212 having a gap shape at the cut portion.

Referring to FIG. 11, in the cylindrical metal case 200 having an opened side to mount components according to the present invention, a portion of a bottom surface 210 of the meal case 200 is cut into the triangular shape in which vertexes thereof are connected to each other, and simultaneously, a side of the cut portion is pressed to form four sound holes 212 having a gap shape at the cut portion.

Referring to FIG. 10, in the cylindrical metal case 200 having an opened side to mount components according to the present invention, a portion of a bottom surface 210 of the meal case 200 is cut into the circular shape, and simultaneously, a side of the cut portion is pressed to form a plurality of sound holes 212 having a gap shape at the cut portion.

Figure 14:
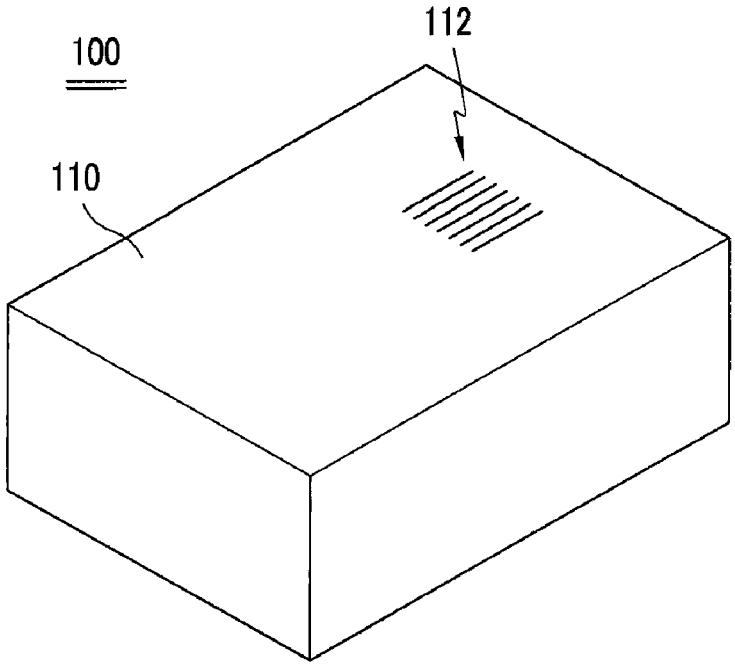
FIGS. 14 and 15 are perspective views of a rectangular parallelepiped condenser microphone case in which a plurality of sound holes is defined in a bottom surface thereof according to the present invention.
Figure 15:
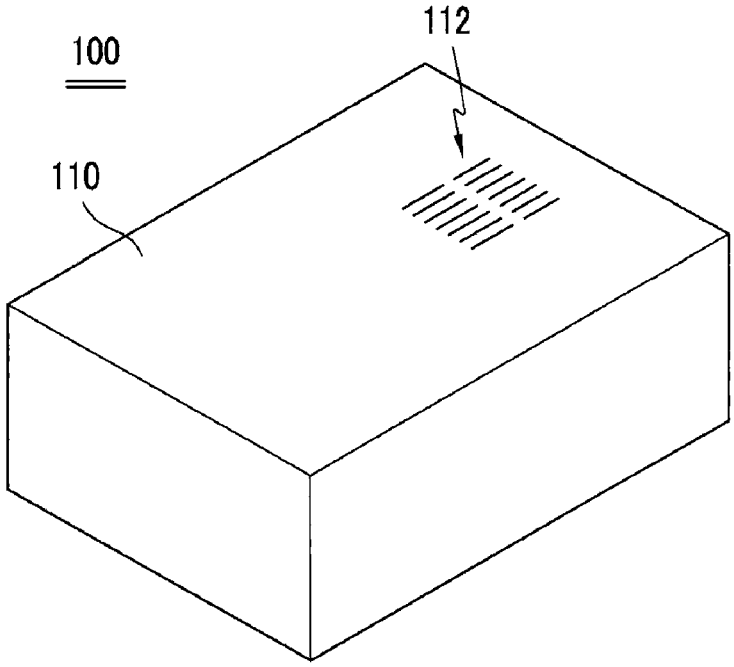
Figure 16:
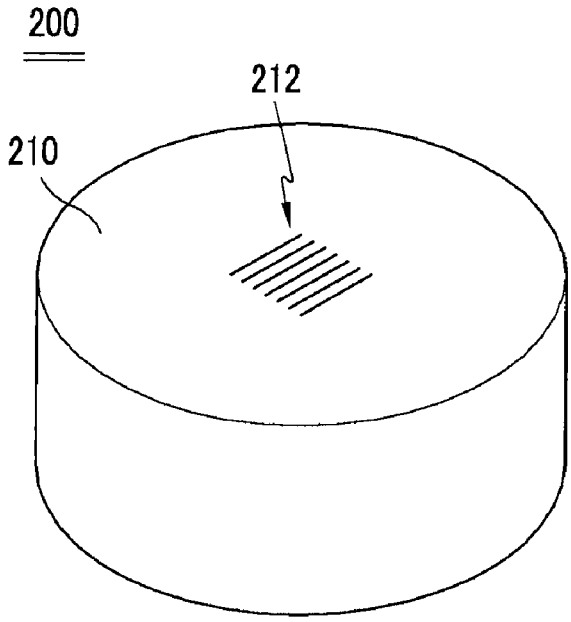
FIGS. 16 and 17 are perspective views of a cylindrical condenser microphone case in which a plurality of sound holes is defined in a bottom surface thereof according to the present invention.
Figure 17:
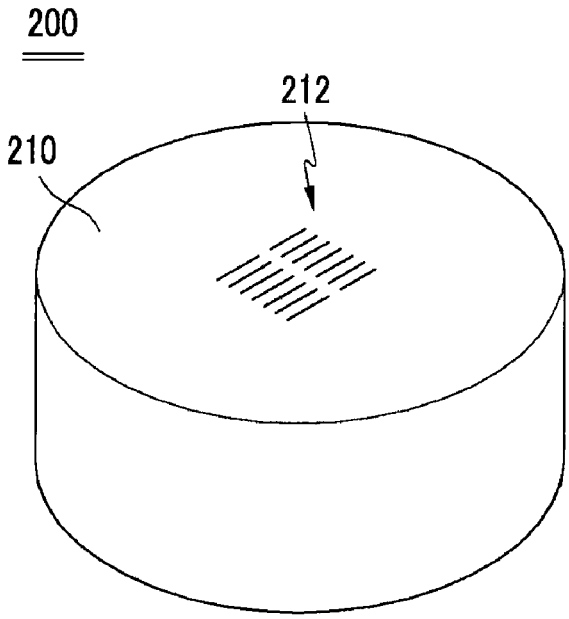

FIGS. 14 and 15 are perspective views of a rectangular parallelepiped condenser microphone case in which a plurality of sound holes is defined in a bottom surface thereof according to the present invention, and FIGS. 16 and 17 are perspective views of a cylindrical condenser microphone case in which a plurality of sound holes is defined in a bottom surface thereof according to the present invention.

Referring to FIGS. 14 to 17, according to condenser microphone cases 100 and 200, a plurality of gap-type sound holes 112 and 212 with one line or a plurality of lines may be defined in rectangular parallelepiped or cylindrical bottom surfaces 110 and 210 having an opened side and formed of a metal material. When the plurality of gap-type sound holes 112 and 212 are formed, external sound may be sufficiently introduced through the small-sized gaps.

According to the present invention, the sound holes having a size through which the foreign substances such as dusts, solder fluxes, and water do not pass may be formed to improve reliability of the condenser microphone. Also, according to the present invention, the sound hole may be formed using a simple method to reduce costs and precisely control the size of the sound hole (gap).

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A method of forming a sound hole in a condenser microphone case, the method comprising:

cutting a portion of a bottom surface of a metal case in the cylindrical metal case having an opened side to mount components for a microphone, and simultaneously, pressing the cut portion to form a sound hole having a gap shape at the cut portion.

2. The method of claim 1, wherein the gap is provided in at least one or of a plurality of cut portions.

3. The method of claim 1, wherein the gap has a polygonal shape.

4. The method of claim 1, wherein the gap has a circular shape.

5. The method of claim 1, wherein a water repellent is coated on a top surface, a bottom surface, or top and bottom surfaces of the gap.

* * * * *